US005987824A

United States Patent [19]

Fuller

[11] Patent Number: 5,987,824

[45] Date of Patent: Nov. 23, 1999

[54] LOCKING MANHOLE COVER

[76] Inventor: Frank E. Fuller, 16224 N. 21st St., Phoenix, Ariz. 85022

[21] Appl. No.: 09/191,083

[22] Filed: Nov. 12, 1998

Related U.S. Application Data

[62] Division of application No. 09/095,514, Jun. 10, 1998.

[51] Int. Cl.[6] ..... E02D 29/14

[52] U.S. Cl. ..... 52/19; 404/25

[58] Field of Search ..... 52/19.21; 404/2, 404/4, 24–26

[56] References Cited

U.S. PATENT DOCUMENTS

| | | | |
|---|---|---|---|
| 3,426,659 | 2/1969 | Clarke . | |
| 4,101,154 | 7/1978 | Kagstrom . | |
| 4,964,755 | 10/1990 | Lewis | 404/25 |
| 4,974,992 | 12/1990 | Harter . | |
| 5,052,851 | 10/1991 | Frishauf . | |
| 5,082,392 | 1/1992 | Marchese | 404/25 |
| 5,328,291 | 7/1994 | Wisniewski . | |
| 5,403,116 | 4/1995 | Brewer . | |

*Primary Examiner*—Beth Aubrey
*Attorney, Agent, or Firm*—LaValle D. Ptak

[57] ABSTRACT

A locking manhole cover which may be made of lighter weight material than conventional iron or steel manhole covers has a cover plate dimensioned to fit over a manhole opening. A cylindrical frame is attached to the underside of the cover plate and extends downwardly into the hole when the cover plate is in place. Diametrically opposed apertures are located in the side of the frame; and movable locking members are hingedly attached to the frame adjacent the apertures for pivotal movement through the apertures from a location within the frame to a location where a portion of the locking members engage the sides of the manhole in which the device is located. An operator is mounted inside the frame for effecting the pivotal movement of the locking members by means of an interacting cam or gear arrangement.

20 Claims, 3 Drawing Sheets

LOCKING MANHOLE COVER

RELATED APPLICATION

This application is a divisional to co-pending application Ser. No. 09/095,514, filed Jun. 10, 1998 for HOLE LOCKING DEVICE.

BACKGROUND

Manhole covers for permanent manhole installations are in widespread use. Typically, manhole covers are constructed in the form of a very heavy circular iron or steel plate, which closely fits into a recess around the lip of the manhole. Such plates require special tools or relatively heavy machinery in order to remove them.

A locking manhole insert cover for suspending equipment beneath the cover is disclosed in the U.S. patent to Wisniewski U.S. Pat. No. 5,328,291. This patent discloses a safety cover for manholes which is to be placed beneath a conventional manhole cover. The safety cover disclosed in the Wisniewski patent includes a plurality of arms which are extended outwardly by rotating a central cam. These arms extend under a lip or flange of the main manhole cover to hold the safety cover in place. A provision is made for locking the arms in place with a padlock; so that the cover cannot be removed.

The U.S. patent to Kagstrom U.S. Pat. No. 4,101,154 discloses a cover for well holes or the like. This cover is equipped with a self-locking mechanism in it. The locking mechanism comprises a pair of diametrically opposed arms, which are pivotally attached to a central shaft extending downwardly from the center of the well cover. The arms have a length chosen to cause them to slidably engage the walls of the hole when the cover is placed over the hole. If an attempt is made to remove the cover, the arms tend to pivot outwardly to more tightly engage the sides of the hole, preventing removal of the cover. When removal is desired, a rod or key is inserted through an aperture in a central tube attached to the cover to engage the lower ends of the pivoting arms to move them out of engagement with the sides of the hole. When the rod is in place, the cover readily can be removed. The arms do not extend into the sides of the well hole, but act as a wedge if an attempt is made to lift the cover from the well opening. Gravity holds the arms in place in the wedging or holding position.

The U.S. patent to Frishauf U.S. Pat. No. 5,052,851 discloses an emergency maintenance hole cover in the form of an inflatable balloon. The configuration of the balloon is in the general shape of a tire or hollow disk connected by a central web. The external edge of the balloon is inserted into the upper edge of the maintenance hole with which it is to be used. The balloon then is inflated; and the resilient material out of which it is made engages the edges of the maintenance hole, preventing water contaminants, animals and the like from passing into the hole. Clearly, this is a temporary installation, which is not intended to remain in place for extended periods of time.

Another patent which is directed to a locking device for locking a cover in place over a repair hole is disclosed in the U.S. patent to Brewer U.S. Pat. No. 4,053,116. The cover of this patent is placed over a vertical exposed tubular pipe in the area of the excavation. A relatively large plate covers the excavation; and a downwardly extending leg on the underside of the cover extends into the exposed pipe. The leg includes an anchoring device which engages the wall of the pipe to hold the assembly in place. The plate, which is the primary cover over the opening, is relatively heavy, requiring construction equipment to lift it into place and to remove it when it no longer is needed.

The U.S. patent to Clarke U.S. Pat. No. 3,426,659 is directed to a road excavation cover which is anchored in place by means of a horizontally arranged jack attached to the underside of the cover. The jack is operated to wedge the ends of the jack into engagement with the sides of the excavation to hold the cover in place; so that it cannot readily be moved or dislodged. This is not a cover for a circular vertical hole.

It is desirable to provide a manhole cover which may be made of lighter weight material than conventional covers, and which readily may be locked in place to secure the manhole against unauthorized exposure while permitting positive and easy release when desired.

SUMMARY OF THE INVENTION

It is an object of this invention to provide an improved manhole cover.

It is another object of this invention to provide an improved locking manhole cover.

It is an additional object of this invention to provide a locking manhole cover which frictionally engages the sides of the manhole shaft to hold it in place.

It is a further object of this invention to provide a locking manhole cover which uses pivoted wedges to hold the cover in place and which is released by pivoting the wedges to a non-locking rest position.

In accordance with a preferred embodiment of the invention, a locking manhole cover includes a portion to fit over the top of the manhole shaft. The cover has a depending frame extending from its underside, with pivotally mounted wedges located to extend outwardly through openings in the frame. A central operator device is provided in the frame to engage the wedges and to cause the wedges to pivotally extend outwardly from the frame to engage the sides of the manhole shaft when the cover is held in place.

DETAILED DESCRIPTION

Figure 1:
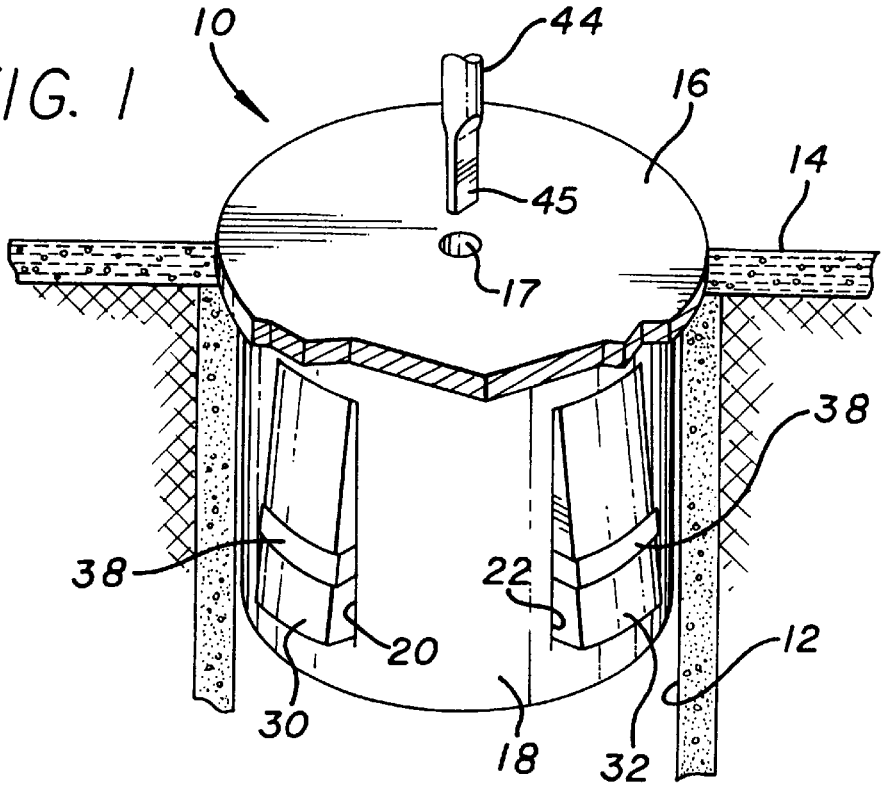
FIG. 1 is a top perspective view of a preferred embodiment of the invention.

Reference now should be made to the drawings, in which the same reference numbers are used throughout the different figures to designate the same components. A locking manhole cover 10 made in accordance with a preferred embodiment of the invention is shown in FIG. 1. The cover 10 includes a circular cover plate 16, which is designed to fit over a flange or opening in a roadway or other surface 14 over a cylindrical manhole 12 extending vertically downwardly from the surface 14. Although a circular cross-section manhole 12 is illustrated, since this is the most common type, it should be noted that other cross-sectional configurations, other than circular, may be employed as well.

Figure 2:
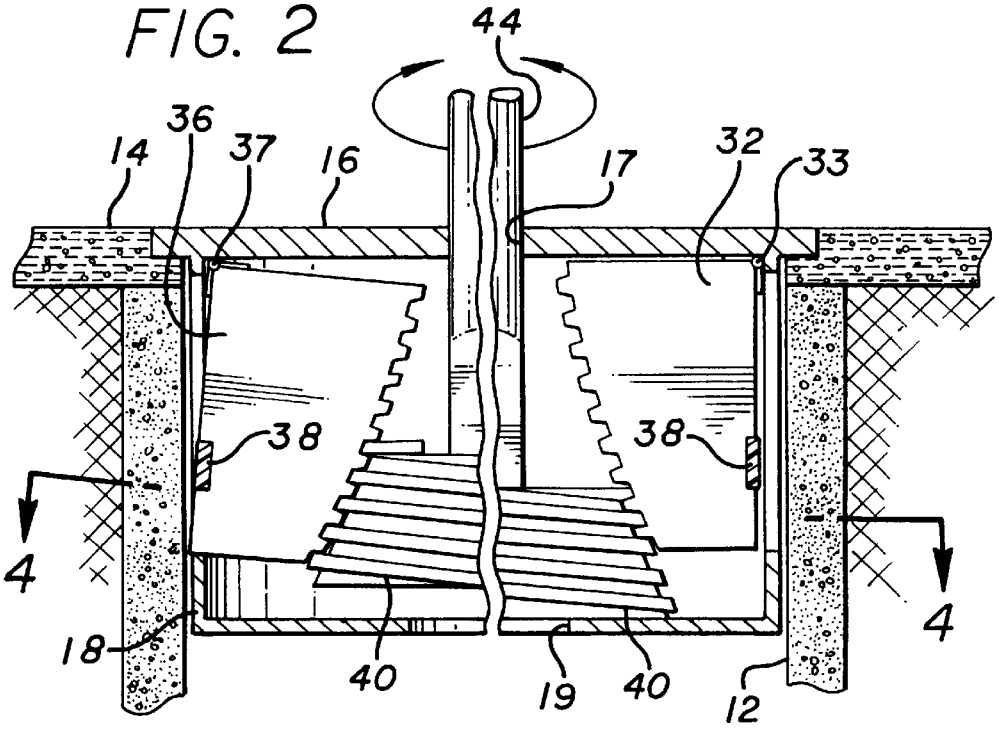
FIG. 2 is a split cross-sectional view of the embodiment shown in FIG. 1 illustrating two positions of operation of the device.
Figure 4:
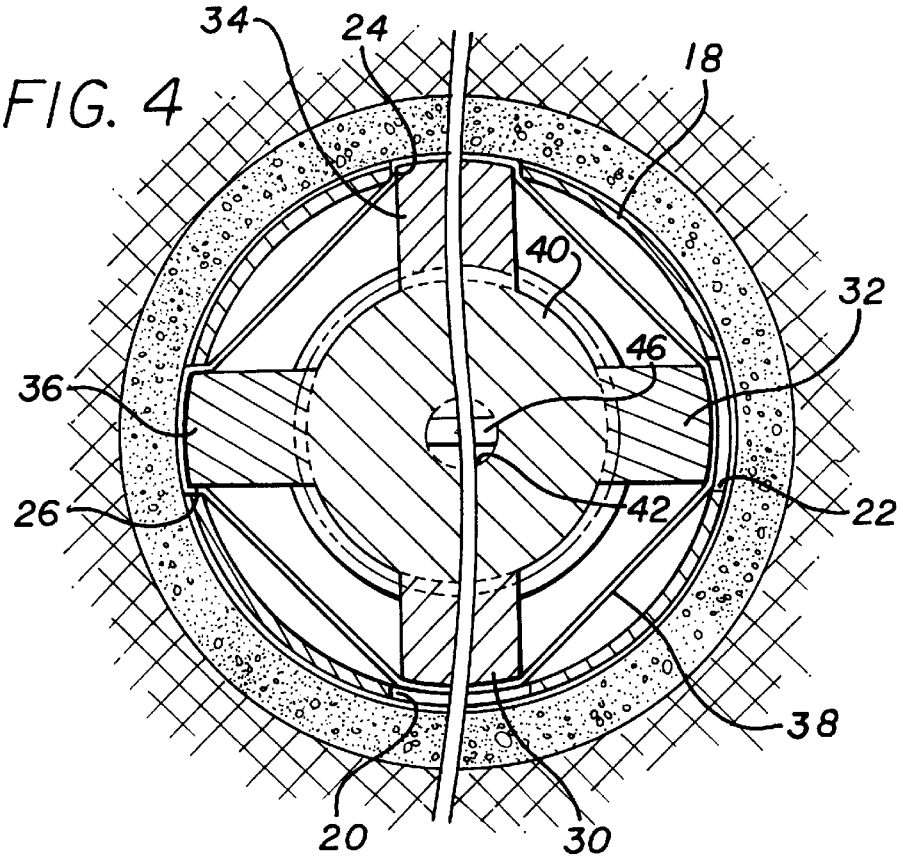
FIG. 4 is a top cross-sectional view taken along the line 4—4 of FIG. 2.

As shown in FIGS. 1, 2 and 4, the cover 16 has a cylindrical frame 18 attached to its underside and depending downwardly from it. The external diameter of the frame 18 is selected to be smaller than the internal diameter of the manhole shaft 12; so that the frame 18 extends into the shaft 12, as illustrated most clearly in FIGS. 1 and 2.

The frame 18 has four rectangular openings 20, 22, 24 and 26 spaced at 90° intervals about its periphery or side. These openings are sized to permit the pivoting outwardly through them of corresponding holding wedges 30, 32, 34 and 36 from a position where the wedges are located entirely within the frame, such as for the wedge 32 shown on the right-hand side of FIG. 2 and the wedges 30, 32, and 34 shown from the top view in FIG. 4. Each of the wedges 30, 32, 34 and 36 is pivoted on a hinge at its upper edge; and hinges 33 and 37 are shown most clearly for the wedges 32 and 36 in FIG. 2. To assist in holding the four wedges in the closed or internal position illustrated by the wedge 32 in FIG. 2, a resilient band 38, in the form of some elastic material such as rubber or the like, extends around all the wedges, as shown most clearly in FIG. 4, to provide a spring type bias to hold the wedges against a truncated, conical operating member 40 located in the central portion of the frame 18. It should be noted that the frame 18 has a bottom in it with a hole 19 through it, which is smaller in diameter than the diameter of the truncated conical operator 40.

When the device is first inserted into a manhole shaft 12, all of the pivoting wedges 30, 32, 34 and 36 are located in the closed or internal position illustrated by the right-hand wedge 32 in the split cross-sectional FIG. 2. Thus, the device is easily inserted into the manhole shaft 12 to the position shown in FIGS. 1 and 2.

To hold the device in place, an operating rod 44 with a chiseled end 45 having a rectangular cross-sectional configuration is inserted through a hole 17 in the top of the cover 16 to extend downwardly through the frame 19 to a slot 46 (FIG. 4) located at the bottom of the conical operating member 40. The member 40 may be solid, as indicated in FIG. 4, with a circular hole 42 through it to accommodate the operating rod 44/45; or it may be hollow with a bottom plate in it having the slot 46 formed in that bottom plate. In any event, the shaft 44 is extended downwardly to engage the rectangular end 45 in the slot 46; so that when the shaft 44 is rotated, the conical operator 40 also is rotated.

Figure 3:
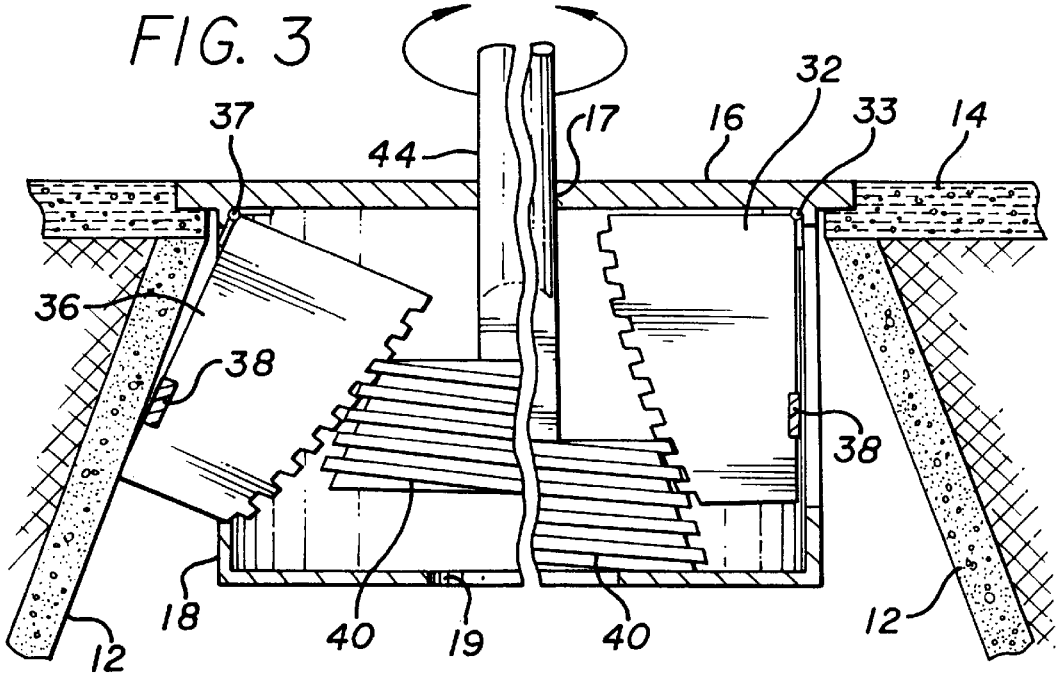
FIG. 3 is a split cross-sectional view of the device of FIG. 2 located in a different manhole construction from that shown in FIG. 2.

As shown most clearly in FIG. 2, each of the wedge-shaped locking members 30, 32, 34 and 36 has rack-type gear surface on it adjacent the exterior of the operator 40, which has a helical operating gear surface, as indicated both in FIGS. 2 and 3. Thus, when the shaft 44 is rotated to cause rotation of the operator 40, the operator 40 engages the gears on the wedge locking devices 30, 32, 34 and 36 to rotate on the mating gear surfaces and to move upwardly. This causes the lower ends of all of the locking members 30, 32, 34 and 36 to pivot outwardly to the position of the operating member 36 shown in the left-hand side of split FIG. 2. When the lower outer edge of the locking members 30, 32, 34 and 36 engage the wall 12 of the manhole shaft, the cover 16 firmly is held in place against removal.

If desired, the lower outer portions of the wedge-shaped members 30, 32, 34 and 36 also may include some frictional material, either built into this portion of these members or placed on the outer surface to increase the holding force of the device. It should be noted, however, that the conical operator 40 is threaded upwardly to a position which creates a substantial amount of force on the lower edges of the hinged locking wedges 30, 32, 34 and 36; so that such additional frictional surface on these members may not be necessary.

Once the device is locked in place as shown in the left-hand side of the cross section of FIG. 2 and for the member 36 shown in FIG. 4, the operating rod 44/45 is removed. The device remains locked in place; so that accidental or unauthorized removal of the cover 16 is not possible.

Because the locking wedges 30, 32, 34 and 36 are employed, it is possible to create the entire assembly, including the cover 16, the frame 18 and all of the parts which are shown in FIGS. 1, 2 and 4, out of relatively lightweight material. The locking cover assembly may be used to replace the existing prior art heavy iron or steel covers, which require a great deal of effort to remove. Authorized removal of the cover which is shown in FIGS. 1, 2 and 4 is achieved by rotating the conical operator 40 to its lowermost position, as shown in the right-hand side of the split cross-sectional view of FIG. 2, to release the pressure of the locking wedges 30, 32, 34 and 36 against the side wall of the manhole shaft 12. When this is done, the cover easily may be lifted out of the hole to permit authorized ingress and egress to the manhole shaft 12.

FIG. 3 is identical to FIG. 2 in every respect with the exception that the manhole shaft 12 is shown as flaring outwardly downwardly from the upper surface. This configuration is used in a number of manhole shafts; and from an examination of FIG. 3, it readily is apparent that the device works equally as well in this type of a configuration to lock the cover 16 in place in the same manner described above in conjunction with the embodiment of FIG. 2. The primary difference in the operation of the embodiment when it is in a flared manhole shaft, such as shown in FIG. 3, is that the operating cone 40 simply is rotated to higher positions; and the corresponding locking wedges 30, 32, 34 and 36 are pivoted outwardly to a greater extent than occurs when the device is used with a shaft 12 of the type shown in FIG. 2. Otherwise, there is no difference in the operation of the device, either to install it or to remove it from the manhole.

Figure 5:
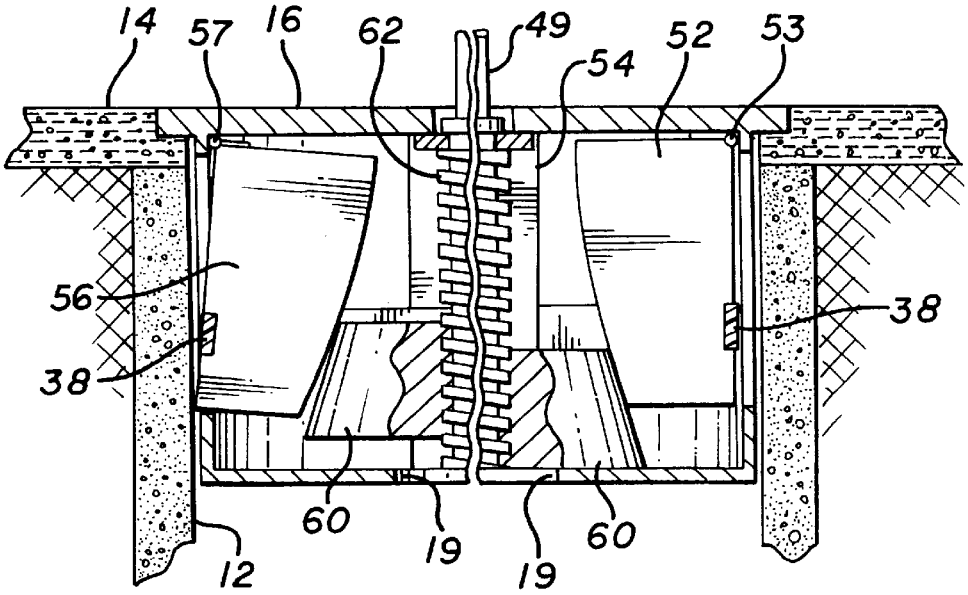
FIG. 5 is a split cross-sectional view of an alternative embodiment to that shown in FIG. 2.

FIG. 5 is an alternative embodiment which is similar to the one shown in FIGS. 2 and 3, but one in which the operating conical member 40 of FIG. 2 is replaced with a smooth surfaced conical operator 60. In addition, the locking wedges are replaced with a corresponding set of smooth surfaced locking wedges 50, 52, 54 and 56, two of which (52 and 56) are shown in the cross-sectional view of FIG. 5. As noted, the interior surfaces of the wedges 52 and 56 (and of 50 and 54 not shown) are curved to engage the sloped outer surface of the conical operator cam 60. In FIG. 5, which is a split cross-sectional view, the right-hand portion shows the device in its closed or unoperated configuration; whereas the left-hand portion shows the device in its locking operation similar to the left-hand portion of FIG. 2. The device of FIG. 5 differs in the manner of operation in that an elongated worm gear 62 extends from the underside of the cover 16 to the lower side of the frame 18 at the opening 19. The gear 62 is rotatably mounted within the frame. The frustroconical operator cam 60 is threaded onto this threaded shaft 62; and the operating rod 44/45 engages an internal slot (not shown) similar to the slot 42 located inside the generally hollow worm shaft 62. When the operator 44/45 is rotated, the worm gear of the shaft 62 rotates and causes the frustroconical operator 60 to move up from the position shown in the right-hand side of FIG. 5 to an intermediate position, such as shown in the left-hand side of FIG. 5. This forces the locking wedge members 52 and 56 to pivot outwardly to the position shown for the member 56 in FIG. 5. In this position, the member 56 engages the side wall of the manhole shaft 12 in the same manner described above in conjunction with FIG. 2. It should be noted that the members 52 and 56 are hinged at their upper edges by means of hinges 53 and 57, similar to the corresponding hinges 33 and 37 described above in conjunction with FIG. 2. The friction between the surfaces of the members 56 and the outer surface of the frustoconical operating member 60 should be sufficient to prevent the member 60 from simply turning along with the gear 62 when the gear 62 is rotated. If this friction, however, is not sufficient, a mating slot and projection may be provided on the inner surface of the frame 18 and the member 60 to prevent the member 60 from rotating, since, for the version shown in FIG. 5, such rotation is not desired.

Figure 6:
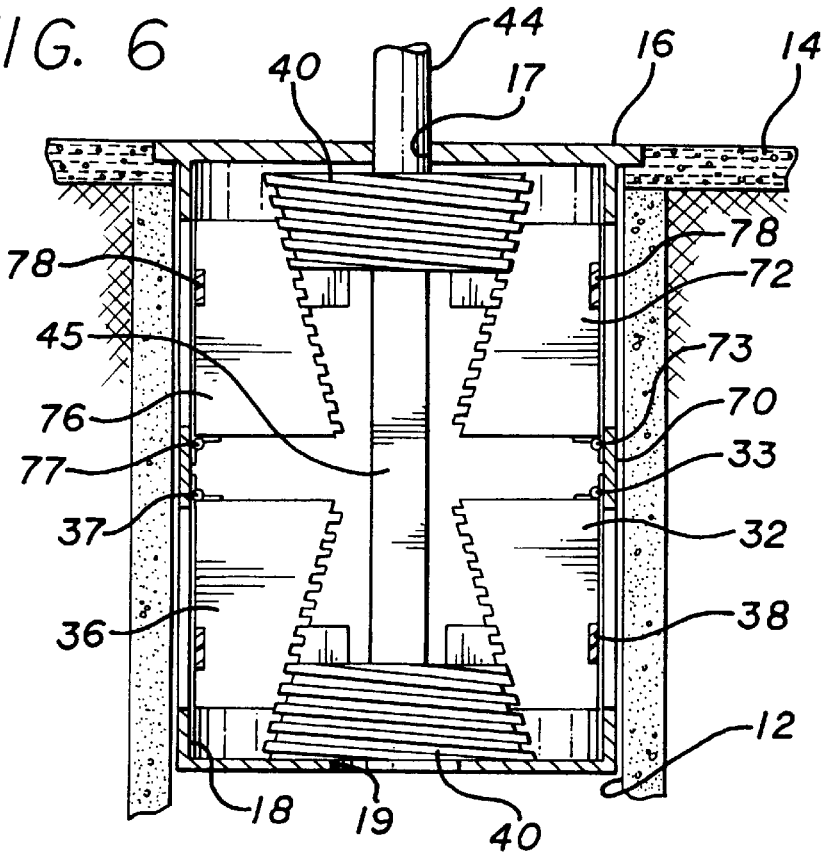
FIG. 6 is a cross-sectional view of another embodiment of the invention.

FIG. 6 is an alternative to the embodiment shown in FIGS. 1, 2 and 4, but which operates in the same manner as the embodiment of these figures. In FIG. 6, the device comprises upper and lower sets of locking wedges which are pivotally mounted near a midpoint of the frame 18. The lower set of wedges comprises four wedges 30, 32, 34 and 36 (only 32 and 36 of which are shown), which are mounted in and operated in an identical manner to the manner of the operation of the wedge set 30, 32, 34 and 36, described previously. These members are hinged at an intermediate point in the housing 18 and are operated by an operator cone 40 in the same manner described previously for the embodiment shown in FIGS. 2 and 4. In addition, however, the device of FIG. 6 includes an upper set of wedges held in a closed position by an elastic band 78, which is similar to the band 38 used with the lower set.

A second frustoconical operator with a helically threaded external surface 80 on it is shown inverted at the top of the mechanism shown in FIG. 6 to move downwardly as the lower operator 40 moves upwardly. When this happens, the wedges 70, 72, 74 and 76 (again, with wedges 72 and 76 being shown) are moved to pivot about their pivot hinges, such as the hinges 73 and 77, to move outwardly into engagement with the side walls of the manhole shaft 12. Thus, two sets of four locking wedges, the lower set hinged at their upper edges and the upper set hinged at their lower edges, are moved outwardly to engage the side of the manhole shaft 12. In all other respects, the device of FIG. 6 operates in the same manner as the device described above in conjunction with FIGS. 1, 2 and 4.

It should be noted that when the device of FIG. 6 is used, an elongated portion 45 on the operating lever 44 is employed to pass entirely through a slot (not shown) in the operator 80, similar to the slot 46 shown in FIG. 4 to extend all the way into the slot 46 of the frustroconical operator 40 shown at the bottom of the device of FIG. 6. When this is done, the devices 40 and 80 both are operated simultaneously move toward one another when the shaft 44 is rotated in one direction, and away from one another when the shaft 44 is rotated in the opposite direction. The principles of operation of this dual activation embodiment are the same as the embodiments described previously.

The foregoing description of the preferred embodiment of the invention should be considered as illustrative, and not as limiting. Various changes and modifications will occur to those skilled in the art for performing substantially the same function, in substantially the same way, to achieve substantially the same result, without departing from the true scope of the invention as defined in the appended claims.

What is claimed is:

1. A locking manhole cover including in combination:

a cover plate having a top and an underside and having dimensions greater than the dimensions of a hole to be covered;

a frame member attached to the underside of said cover plate having a side extending downwardly from said cover plate and dimensioned to fit into and extend downwardly into the hole, said frame having at least one aperture through the side thereof;

a movable locking member hingedly attached to said frame member adjacent the aperture therethrough for pivotally moving said locking member through said aperture from a location within said frame member to a location engaging the hole; and an operator device mounted in said frame member for effecting said pivotal movement of said locking member.

2. The combination according to claim 1 wherein said operator device is a vertically movable device located within said frame member having a surface thereon engaging a mating surface of said locking member for effecting said pivotal movement of said locking member.

3. The combination according to claim 2 wherein said movable locking member has a free end and a hinged end, with a rear surface extending radially into said frame member a first distance at the hinged end and a second distance at the free end thereof, said first distance being greater than said second distance.

4. The combination according to claim 3 wherein said operator device comprises a generally frustroconical-shaped device mounted for vertical movement within said frame member and having an external surface engaging said locking member.

5. The combination according to claim 4 wherein said operator device is externally threaded and the rear surface of said locking member is threaded and in engagement with said operator device and further including a device for rotating said operator device to engage mating threads on the rear surface of said locking member to effect said pivotal movement thereof.

6. The combination according to claim 4 wherein said operator device and said locking member have mating cam surfaces thereon for effecting said pivotal movement.

7. The combination according to claim 6 wherein said cover plate is a circular cover plate for covering a circular manhole and said frame member is a cylindrical frame member with a side wall and having an aperture through the side wall thereof.

8. The combination according to claim 7 wherein said frame member has at least diametrically opposed first and second apertures through the side thereof, and said movable locking member comprises first and second movable locking members each respectively hingedly attached to said frame member adjacent said first and second apertures for pivotal movement of said locking members through said respective apertures, and said operator device is mounted in said frame member for effecting pivotal movement of both of said first and second locking members simultaneously.

9. The combination according to claim 1 wherein said operator device is externally threaded and the rear surface of said locking member is threaded and in engagement with said operator device and further including a device for rotating said operator device to engage mating threads on the rear surface of said locking member to effect said pivotal movement thereof.

10. The combination according to claim 9 wherein said movable locking member has a free end and a hinged end, with a rear surface extending radially into said frame member a greater distance at the hinged end than the distance the rear surface of said locking member radially extends into said frame member at the free end thereof.

11. The combination according to claim 10 wherein said frame member has at least diametrically opposed first and second apertures through the side thereof, and said movable locking member comprises first and second movable locking members each respectively hingedly attached to said frame member adjacent said first and second apertures for pivotal movement of said locking members through said respective apertures, and said operator device is mounted in said frame member for effecting pivotal movement of both of said first and second locking members simultaneously.

12. The combination according to claim 1 wherein said operator device and said locking member have mating cam surfaces thereon for effecting said pivotal movement.

13. The combination according to claim 12 wherein said operator device comprises a generally frustroconical-shaped device mounted for vertical movement within said frame member and having an external surface engaging said locking member.

14. The combination according to claim 13 further including a biasing device for resiliently biasing said locking member toward a location within said frame member.

15. The combination according to claim 1 wherein said cover plate is a circular cover plate for covering a circular manhole and said frame member is a cylindrical frame member with a side wall and having an aperture through the side wall thereof.

16. The combination according to claim 15 further including a biasing device for resiliently biasing said locking member toward a location within said frame member.

17. The combination according to claim 16 wherein said operator device is a vertically movable device located within said frame member having a surface thereon engaging a mating surface of said locking member for effecting said pivotal movement of said locking member.

18. The combination according to claim 1 further including a biasing device for resiliently biasing said locking member toward a location within said frame member.

19. A locking manhole cover including in combination:

a cover plate having an upper surface and a lower surface and having a diameter greater than a hole to be covered;

a cylindrical frame member attached to the lower surface of said cover plate and having dimensions selected to fit into said hole and to extend downwardly into said hole from said cover plate, said frame member having at least two sets of diametrically opposed apertures therethrough with said sets of apertures being axially displaced in said frame member;

movable locking members hingedly attached to said frame members adjacent each of the apertures therethrough for pivotal movement of said locking members through the corresponding aperture from a location within said frame member; and an operator device mounted in said frame member for effecting said pivotal movement of said locking members through the apertures in said frame member.

20. The combination according to claim 19 wherein said first and second sets of apertures comprise upper and lower sets of apertures, each with upper and lower edges, and wherein said movable locking members corresponding to said upper set of apertures are hingedly attached adjacent the lower edge of said apertures, and wherein said movable locking members corresponding to the lower set of apertures are hingedly attached adjacent the upper edge of said apertures when said locking manhole cover is in place over a manhole opening.

* * * * *